United States Patent [19]

Ness

[11] 4,205,101

[45] May 27, 1980

[54] PRETREATMENT PROCESS

[75] Inventor: Norman M. Ness, Taplow, England

[73] Assignee: Imperial Chemical Industries Limited, London, England

[21] Appl. No.: 766,785

[22] Filed: Feb. 8, 1977

Related U.S. Application Data

[63] Continuation-in-part of Ser. No. 605,174, Aug. 15, 1975, abandoned.

[30] Foreign Application Priority Data

Aug. 19, 1974 [GB] United Kingdom ..... 36359/74

[51] Int. Cl.[2] ..... B05D 7/22

[52] U.S. Cl. ..... 427/233; 427/236; 427/421; 427/424; 427/425

[58] Field of Search ..... 427/421, 424, 425, 236, 427/233, 234; 118/314, 315, 316, 322, 324, 306, 317

[56] References Cited

U.S. PATENT DOCUMENTS

| | | | |
|---|---|---|---|
| 2,321,982 | 6/1943 | Brackett | 118/316 |
| 2,598,163 | 5/1952 | Halls | 427/234 |
| 3,011,911 | 12/1961 | Morey | 427/236 |
| 3,037,223 | 6/1962 | Lousey | 118/314 UX |
| 3,133,828 | 5/1964 | Slatkin | 118/316 X |
| 3,227,575 | 1/1966 | Zibart | 427/236 |
| 3,255,037 | 6/1966 | Knight et al. | 427/424 |
| 3,259,138 | 7/1966 | Heinicke | 118/314 X |
| 3,477,870 | 11/1969 | Boretti et al. | 427/424 |
| 3,619,311 | 11/1971 | Rose et al. | 427/424 X |
| 3,640,758 | 2/1972 | Hogstrom et al. | 118/316 X |
| 3,705,817 | 12/1972 | Darr | 427/424 X |
| 3,724,415 | 4/1973 | Knight | 477/424 X |
| 3,724,415 | 4/1973 | Knight | 427/424 |
| 3,791,842 | 2/1974 | Neal | 118/314 X |
| 3,952,699 | 4/1976 | Darr et al. | 427/424 X |

*Primary Examiner*—Shrive P. Beck

*Attorney, Agent, or Firm*—Cushman, Darby & Cushman

[57] ABSTRACT

Method of treating automotive and like bodies with a pretreatment liquid in which the body is traversed with respect to a multiplicity of orifices for projection of the liquid at the body, the longitudinal axis of the body being at right angles to the direction of traverse and the major part of the liquid being projected at an angle to the longitudinal plane of symmetry of the body in the range 30°-60°.

12 Claims, 4 Drawing Figures

PRETREATMENT PROCESS

This application is a continuation-in-part of Ser. No. 605,174 filed Aug. 15th, 1975 and now abandoned.

This invention relates to a method of treating automobile and like hollow bodies with a pretreatment liquid.

It is common practice before painting to apply to a metal automobile body a chemical liquid, for example a cleaning liquid and/or a pretreatment liquid such as a solution of acidic zinc phosphate. The metal is thereby cleaned and/or is provided with a coating, which is resistant to corrosion and forms a more suitable basis for subsequent painting than the untreated metal. With automobile and like hollow bodies of complex shape it is desirable that, as well as cleaning and coating the exterior of the body, the cleaning and/or pretreatment chemical reaches substantially the whole of the interior of the body and, wherever possible, any concealed, recessed or box sections of the body.

It is present standard practice to suspend the body in its roadwise position, optionally with an end to end tilt in order to aid drainage, and to traverse it in the roadwise position past a multiplicity of orifices from which the chemical liquid is projected at the body. Apertures in the body, for example such as to receive windows or doors, permit the ingress of the liquid. The body is subsequently drained, rinsed and optionally dried before painting. In such practice the majority of orifices are orientated so that they project liquid vertically and horizontally at right angles to the direction of traverse of the body but for efficient cleaning and coating of the interior, some orifices must be orientated such that the liquid enters apertures in the body surface at an angle which is oblique to the direction of traverse. Disadvantages of such practice are that (a) certain orifices must always be orientated in a direction which is different from that of the other orifices; (b) reorientation of the orifices may be required for different shapes of body; (c) any blockage of the orifices of different orientation has an adverse effect on performance; (d) there is poor cleaning and/or coating of the interior of bodies which do not have many side apertures e.g. van bodies, and (e), due to the significant length of the roadwise position in many cases, long drainage and rinse times are required and streaking by chemical liquid may occur due to the time taken for the whole body to be wetted when entering the zone of orifices. An example of disadvantage (e) when the chemical liquid is a pretreatment liquid, is the streaking which is due to "pre-phosphating".

We have now found that the above disadvantages can be overcome or reduced in a method of treating a metal automotive hollow body which contains apertures to receive windows or doors with a pretreatment liquid wherein the body is traversed with respect to a multiplicity of orifices through which the pretreatment liquid is projected at the body and wherein the longitudinal axis of the body is at right angles to its direction of traverse and the body is placed in such relation to the orifices that the major part of the liquid with which the body is treated is projected at an angle to the longitudinal plane of symmetry of the body within the range of 30°-60° and coats to the interior and exterior of the body which is rendered resistant to corrosion.

Preferably the angle to the longitudinal plane of symmetry at which the major part of liquid is projected is substantially 45°. The apertures permit the ingress of liquid.

By the longitudinal axis of the automotive or like body we mean that axis which extends through the centre of and throughout the greatest dimension of (usually the length of) the body. In the case of an automotive body the greatest dimension is usually that measured along its roadwise position. By the longitudinal plane of symmetry of the automotive or like body we means, for example, the vertical plane of symmetry which passes through the longitudinal axis. In the case of an automotive body the vertical plane of symmetry is taken in relation to its roadwise position.

Preferably the automotive or like body is traversed past the multiplicity of orifices projecting liquid either with its longitudinal axis substantially vertical or with this axis substantially horizontal, so that the body is traversed whilst suspended from one of its two extremities or whilst suspended crosswise to the direction of traverse, i.e. substantially at right angles to a line along the direction of traverse. In these defined and preferred positions the body can be suitably aligned in relation to the orifices such that the major part of the liquid with which the body is treated is projected at an angle to the longitudinal plane of symmetry within the range 30°-60°.

In one preferred method according to the invention automotive or like bodies are suspended from one of their two extremities and are traversed past a multiplicity of orifices which project a liquid at the bodies, for example in substantially horizontal and vertical planes, substantially at right angles to the direction of traverse, the longitudinal plane of symmetry of the bodies being inclined at approximately 45° to the direction of traverse. In a modification of this method the longitudinal plane of symmetry is periodically rotated through about 90°. In another preferred method the automotive or like bodies are suspended as just described and are traversed so that their longitudinal plane of symmetry is along the line of traverse but the orifices project liquid at an angle of about 45° to the longitudinal plane of symmetry of the bodies. The orifices may be arranged in any suitable manner along the direction of traverse for example in a sequence of groups such that one group of orifices projects liquid in a direction substantially at right angles to that of the previous group. Alternatively the orifices may be arranged such that liquid is simultaneously projected at the body in directions which are substantially at right angles to each other.

In another preferred method automotive or like bodies are suspended with their longitudinal axis crosswise to and usually at right angles to the direction of traverse and are progressed either with their longitudinal plane of symmetry inclined at about 45° to the direction of traverse and in relation to a sequence of orifices which project liquid substantially at right angles to the direction of traverse, or else the orifices are suitable angled to the direction of traverse and to the longitudinal plane of symmetry. In one embodiment of this method the direction of traverse and the direction of liquid projection may each change periodically through substantially 90°, for example a "sawtooth" configuration. In a further method the bodies may be progressed in a square wave configuration. In such methods the bodies may be at least partially immersed in a pretreatment liquid at any suitable stage, for example when they reach a low-point in their travel.

The invention is illustrated with reference to the attached drawings wherein.

Figure 1:
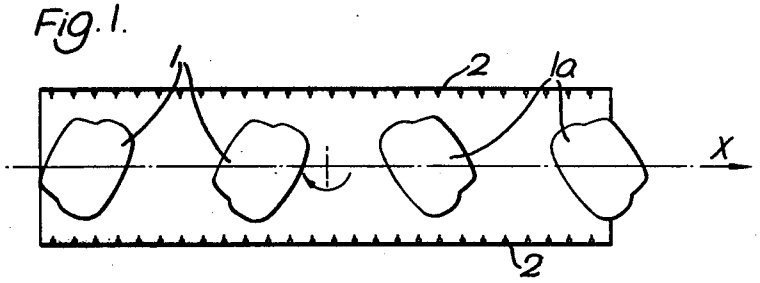
FIG. 1 represents the plan view of a plant wherein automotive bodies are treated according to the invention and wherein the bodies are traversed with their longitudinal axis in a vertical plane.

With reference to FIG. 1, X represents the direction of traverse of automotive bodies 1 and 1*a* which are traversed past a multiplicity of orifices 2. The orifices are arranged so that some can project liquid horizontally and some vertically at right angles to the direction of traverse of the bodies. The longitudinal plane of symmetry of the automotive bodies is inclined at approximately 45° to the direction of traverse.

Automotive bodies 1*a* have been re-aligned so that their longitudinal plane of symmetry is approximately at right angles to that of bodies 1. Further benefit is thus achieved and in one embodiment the bodies are periodically rotated through 90°.

this embodiment the bodies are conveyed along a path which ensures that the orientation of the bodies with respect to the orifices or jets is periodically moved through 90°. The orifices may be arranged such that liquid is projected at the body simultaneously from directions at right angles to each other. An advantage of this embodiment is that the bodies can be at least partially immersed in a bath of pretreatment or other chemical liquid 3.

Figure 4:
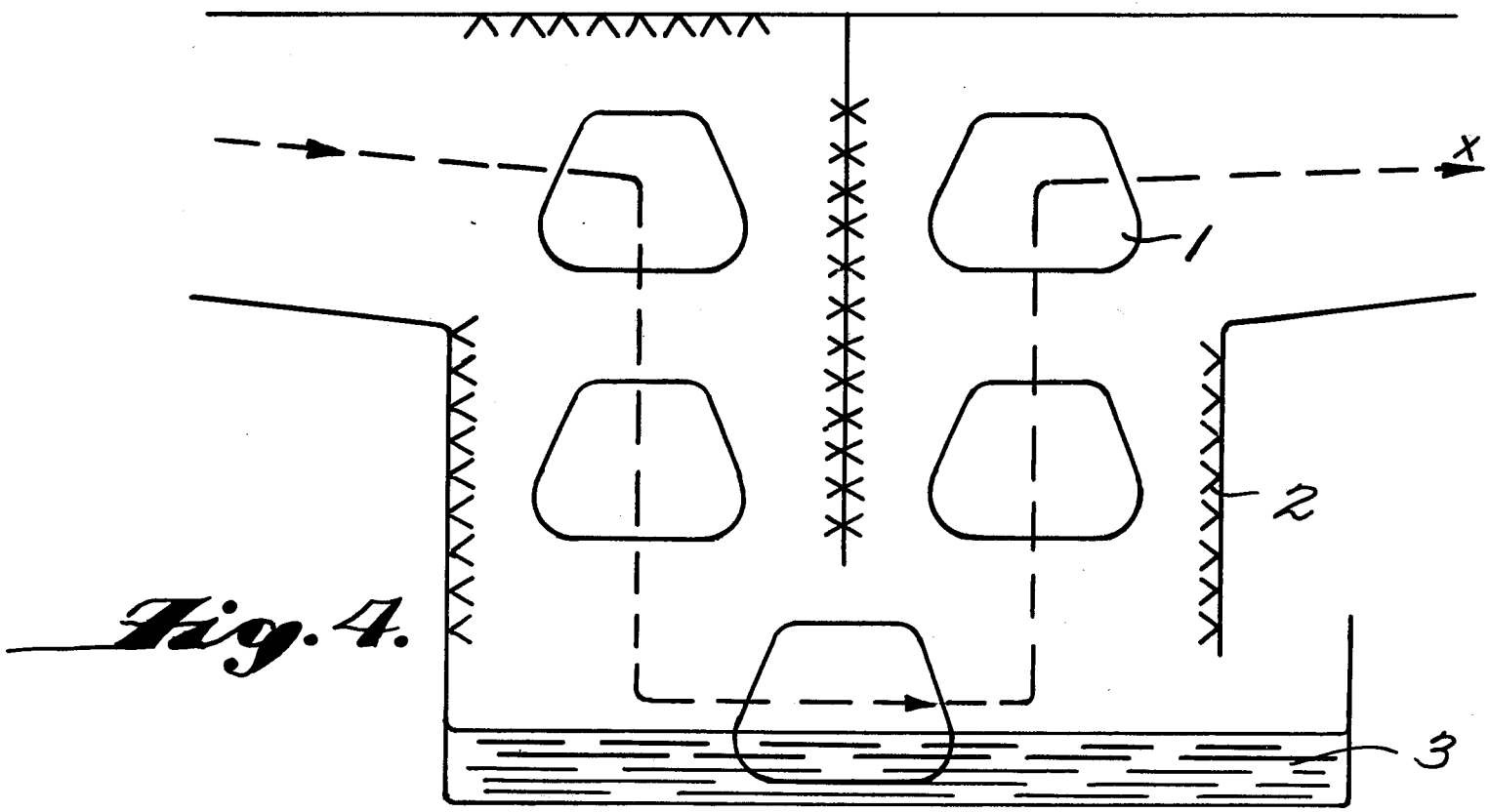
FIG. 4 represents a side view of a further plant wherein automotive bodies are treated according to the invention and wherein the bodies are progressed along a path having a square wave configuration.

With reference to FIG. 4 automotive bodies 1 having their longitudinal axis transverse to the direction of traverse are traversed past an arrangement of orifices whereby liquid is projected at the bodies simultaneously in two directions which are substantially at right angles to each other, each direction being at substantially 45° to the longitudinal plane of symmetry.

Figure 2:
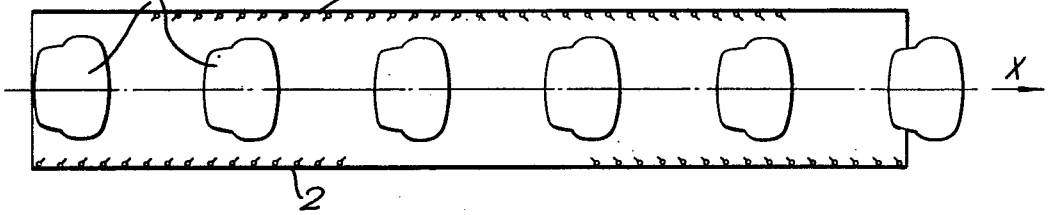
FIG. 2 represents a side view of a further plant wherein automotive bodies are treated according to the invention and wherein the bodies are traversed with their longitudinal axis in a horizontal plane crosswise to the direction of traverse.

In another preferred embodiment of the invention automotive bodies are progressed in relation to orifices which project liquid in directions which are at right angles to each other, as illustrated in FIG. 2, and the bodies are also lowered at any suitable stage to immerse at least the lower regions of the body in a bath of pretreatment liquid.

The present standard practice of treating such automotive bodies with a pretreatment liquid by the "spray process" has been outlined at the beginning of this specification. Such a spray process of pretreatment may also comprise a stage in which at least the lowest regions of the body are immersed in the pretreatment liquid (the "spray-dip process"). The clear advantages of the two embodiments of the present invention which are illustrated by FIGS. 3 and 4 respectively over the convention spray or spray-dip processes are summarised below:

| PLANT | DISADVANTAGES | ADVANTAGES |
|---|---|---|
| Conventional "spray process" and "spray-dip process" (body in roadwise position) | 1. Very long plant<br>2. Long process stages<br>3. Long drain stages<br>4. Poor cleaning of van interiors<br>5. Less efficient cleaning of fronts and rears than sides<br>6. Adjustable jets required<br>7. Critical jet positioning<br>8. Intolerant to change in body shape<br>9. Sensitive to blocking of certain jets<br>10. Often prone to streaking through, for example, "prephosphating"<br>11. Higher conveyor speed for given output<br>12. Higher overspray and carry over between stages<br>13. Poor cleaning of box sections (spray only) | 1. Single monorail conveyor adequate<br>2. Low, narrow plant |

With reference to FIG. 2, automotive bodies 1 are traversed past orifices or jets 2 which are inclined at 45° to the longitudinal plane of symmetry of the bodies and to the direction of traverse. The orifices are also arranged such that the liquid is simultaneously projected in directions which are at right angles to each other.

Figure 3:
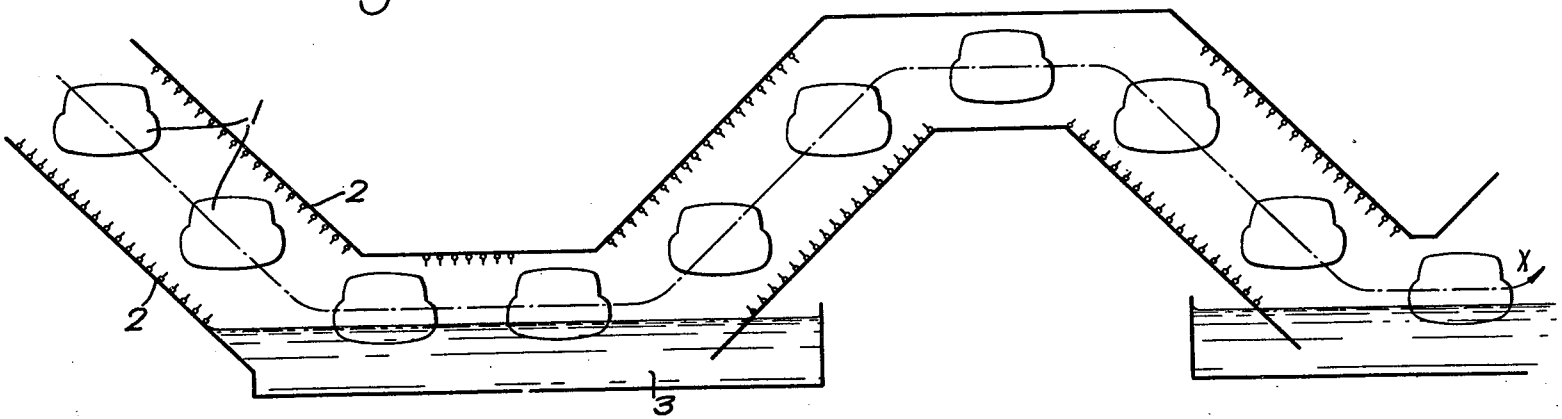
FIG. 3 represents a side view of a further plant wherein automotive bodies are treated according to the invention and wherein the bodies are traversed with their longitudinal axis horizontal but crosswise to the direction of travel along a path having a "saw-tooth" configuration.

With reference to FIG. 3 automotive bodies 1 having their longitudinal axis transverse to the direction of traverse X and their longitudinal plane of symmetry inclined at approximately 45° to the line of traverse are traversed past orifices or jets which project pretreatment liquid at right angles to the direction of travel. In

| PLANT | DISADVANTAGES | ADVANTAGES |
|---|---|---|
| | 1. Twin conveyors<br>2. Wider plant<br>3. Higher plant | 1. Easy body handling<br>2. Short process stages<br>3. Short drain stages<br>4. No streaking through, for example, "prephosphating"<br>5. Low sprayover<br>6. Good cleaning of box sections<br>7. Body rotation to give preferred orientation to |

-continued

| PLANT | DISADVANTAGES | ADVANTAGES |
|---|---|---|
| Process of Fig. 3 | | orifices occurs by gravity without special mechanism<br>8. Pumps etc., housed under arches leaves clear gangways<br>9. Lower conveyor speed for given output |

| PLANT | DISADVANTAGES | ADVANTAGES |
|---|---|---|
| Process of Fig. 4 ("Square Wave") | 1. Twin complex conveyor system required<br>2. Higher, wider plant. | 1. Very short and compact plant<br>2. Short process stages<br>3. Short drain stages<br>4. Capable of good cleaning of van interiors<br>5. Fixed position jets<br>6. Tolerant to random jet blocking and changes in body shape<br>7. Not prone to streaking through "prephosphating"<br>8. Lower conveyor speed for given output<br>9. Low overspray and carry over between stages<br>10. Good cleaning of box sections in dip zones<br>11. Good thermal separation of stages<br>12. Pumps etc., can be housed under arches to leave gangways clear |

We claim:

1. A method of treating a metal automotive hollow body which contains apertures to receive windows or doors with a pretreatment liquid which is capable of rendering the metal of said body resistant to corrosion wherein the body is traversed with respect to a multiplicity of orifices through which the pretreatment liquid is projected at the body and wherein the longitudinal axis of the body is at right angles to its direction of traverse and the body is placed in such relation to the orifices that the major part of the liquid with which the body is treated is projected at an angle to the longitudinal plane of symmetry of the body within the range 30°–60° and coats the interior and exterior of the body which is rendered resistant to corrosion.

2. A method according to claim 1 wherein the major part of the pretreatment liquid is projected at an angle to the longitudinal plane of symmetry of about 45°.

3. A method according to claim 1 wherein the longitudinal axis of the body is substantially vertical.

4. A method according to claim 1 wherein the longitudinal axis of the body is substantially horizontal.

5. A method according to claim 1 wherein the longitudinal axis of the body is substantially vertical and the longitudinal plane of symmetry of the body is inclined at about 45° to the direction of traverse, pretreatment liquid being projected from orifices at right angles to the direction of traverse.

6. A method according to claim 1 wherein the longitudinal plane of symmetry is periodically rotated through about 90°.

7. A method according to claim 1 wherein the longitudinal axis of the body is substantially vertical and the longitudinal plane of symmetry of the body is parallel to the line of traverse, pretreatment liquid being projected from orifices at an angle of about 45° to the line of traverse.

8. A method according to claim 1 wherein the longitudinal axis of the body is horizontal and the longitudinal plane of symmetry is inclined at about 45° to the direction of traverse, the direction of traverse and the direction of projection of pretreatment liquid each changing periodically through about 90°.

9. A method according to claim 1 wherein the longitudinal axis of the body is substantially horizontal and the longitudinal plane of symmetry is substantially vertical and the body is traversed along a path having a square wave configuration.

10. A method according to claim 1 wherein the orifices are arranged such that pretreatment liquid is projected at the body simultaneously in directions which are at right angles to each other.

11. A method according to claim 1 wherein the pretreatment liquid comprises a solution of acidic zinc phosphate.

12. A method consisting essentially of the method of claim 1.

* * * * *